US010668360B2

(12) United States Patent
Uchiyama et al.

(10) Patent No.: US 10,668,360 B2
(45) Date of Patent: Jun. 2, 2020

(54) CARD COLLECTION STORAGE AND CARD PROCESSING DEVICE

(71) Applicant: NIDEC SANKYO CORPORATION, Suwa-gun, Nagano (JP)

(72) Inventors: Ryo Uchiyama, Nagano (JP); Keiji Ohta, Nagano (JP)

(73) Assignee: NIDEC SANKYO CORPORATION, Suwa-Gun Nagano (JP)

( * ) Notice: Subject to any disclaimer, the term of this patent is extended or adjusted under 35 U.S.C. 154(b) by 0 days.

(21) Appl. No.: 16/162,979

(22) Filed: Oct. 17, 2018

(65) Prior Publication Data

US 2019/0118071 A1 Apr. 25, 2019

(30) Foreign Application Priority Data

Oct. 20, 2017 (JP) ..... 2017-203342

(51) Int. Cl.

| | |
|---|---|
| ***A63F 1/10*** | (2006.01) |
| ***A63F 1/06*** | (2006.01) |
| ***A63F 1/14*** | (2006.01) |
| *A63F 9/24* | (2006.01) |
| *G07F 11/14* | (2006.01) |
| *A63F 1/12* | (2006.01) |
| *A63F 11/00* | (2006.01) |

(52) U.S. Cl.

CPC ..... *A63F 1/062* (2013.01); *A63F 1/10* (2013.01); *A63F 1/14* (2013.01); *A63F 1/12* (2013.01); *A63F 11/0002* (2013.01); *A63F 2009/2419* (2013.01); *A63F 2250/186* (2013.01); *G07F 11/14* (2013.01)

(58) Field of Classification Search

CPC ..... A63F 1/10; A63F 1/12; A63F 1/14; A63F 11/0002; G07F 11/14

USPC ..... 273/149 R, 149 P, 148 A, 148 R

See application file for complete search history.

(56) References Cited

U.S. PATENT DOCUMENTS

| | | | | |
|---|---|---|---|---|
| 4,807,884 A * | 2/1989 | Breeding | ..... | A63F 1/12 273/149 R |
| 8,998,210 B2 * | 4/2015 | Shigeta | ..... | A63F 1/14 273/148 R |
| 2009/0302537 A1 * | 12/2009 | Ho | ..... | A63F 1/12 273/149 R |
| 2011/0285082 A1 * | 11/2011 | Krenn | ..... | A63F 1/12 273/149 R |

FOREIGN PATENT DOCUMENTS

JP 2008165483 A 7/2008

* cited by examiner

*Primary Examiner* — Benjamin Layno
(74) *Attorney, Agent, or Firm* — Cantor Colburn LLP

(57) ABSTRACT

A card collection may include a box-shaped card storing portion having an open top, in which the collected cards are stacked. The the card storing portion may include a front portion configuring, a rear portion configuring, two side portions, and a plate-shaped placement board having a placement surface on which the cards are to be placed. The placement surface is inclined upward toward a front side. A rear end of the placement board is connected to the rear portion, a front end of the placement board is separated from the front portion and at least front portions at the left and right ends of the placement board are separated from the side portions, and the placement board, the front side of which moves in the top-bottom direction, can be elastically deformed.

23 Claims, 5 Drawing Sheets

CARD COLLECTION STORAGE AND CARD PROCESSING DEVICE

CROSS REFERENCE TO RELATED APPLICATION

The present application claims priority under 35 U.S.C. § 119 to Japanese Application No. 2017-203342 filed Oct. 20, 2017, the entire content of which is incorporated herein by reference.

FIELD OF TECHNOLOGY

At least an embodiment of the present invention relates to a card collection storage in which cards collected by a card processing device are stored. At least an embodiment of the present invention also relates to a card processing device equipped with a card collection storage.

BACKGROUND

Conventionally known is a card issuing device which is equipped with a card issuing function and a card collecting function (Patent Reference 1, for example). A card issuing device disclosed in Patent Reference 1 is equipped with a card reader, a card issuing unit which issues cards, and a card collection storage for collecting un-needed cards. The card collection storage is formed in a rectangular box shape with the top open and secured to the device frame of the card issuing device. The card collection storage is arranged below the card issuing unit. Also, the card collection storage is positioned at the diagonally lower back of the card reader.

In the card issuing device disclosed in Patent Reference 1, the un-needed cards ejected to the back side from the card reader are taken diagonally from upper front and stored in a card collection storage. In the card collection storage, cards are stored in a stack. The bottom portion configuring the bottom surface of the card collection storage is inclined upwardly toward the front side so that the collected cards may be stored in the card collection storage in an orderly manner. Therefore, the front portion of the cards (the end portion [of the cards] on the card reader side) collected in the card collection storage will be higher than the rear portion of the card.

PATENT REFERENCE

[Patent Reference 1] Unexamined Japanese Patent Application 2008-165483 Publication

SUMMARY

In the card issuing device of Patent Reference 1, the card collection storage is secured to the device frame of the card issuing device; therefore, in order to take the multiple cards collected in the card collection storage out of the card issuing device, the multiple collected cards need to be taken out non-collectively from an opening, etc. created in the device frame. Therefore, this type of card issuing device makes the operation of removing the collected cards troublesome.

Therefore, the inventor of this application has considered the installation of a card collection storage which can be attached to and detached from the device frame so that the multiple cards collected in the card collection storage can be taken out collectively. The inventor of this application has also considered that the collection storage be inserted to the device frame from the back of the device frame to be mounted to the device frame and the card collection storage be pulled from the device frame to the back to be extracted from the device frame.

However, when the bottom portion of the card collection storage is inclined upwardly toward the front side to orderly store the collected cards in the card collection storage, the cards which are stacked in the card collection storage also incline upwardly toward the front side; therefore, if the cards of more than a predetermined number are stored in the card collection storage, the front end portions of the cards stacked in the top in the card collection storage tend to stick out higher than the top end of the card collection storage.

When the card collection storage in which the front ends of [some of] the collected cards stick out higher than the top end thereof is pulled from the device frame to the back side, the top surface of the card on top of the stack and the device frame may contact each other. Also, if the top surface of the card on top of the stack of the cards collected in the card collection storage and the device frame are in contact with each other when the card collection storage is pulled from the device frame to the back side, the top card may be caught by the device frame, and therefore, the card collection storage cannot be extracted to the back [successfully].

At least an embodiment of the present invention, provides a card collection storage into which cards collected by a card processing device are taken diagonally from the upper front and which is to be pulled to the back side of a device frame of the card processing device and to be removed from the device frame, wherein although the placement surface on which the cards collected in the card collection storage are to be placed is inclined upwardly toward the front side, [the card collection storage] having the cards of more than a predetermined number stacked therein can be extracted from the device frame to the back side. At least an embodiment of the present invention provides a card processing device equipped with this card collection storage.

To achieve the above, the card collection storage of the present invention is a card collection storage into which cards collected by a card processing device are taken diagonally from the upper front and which is inserted to the device frame from the back side of the device frame of the card processing device and attached to the device frame and is to be pulled to the back side of the device frame and removed from the device frame; wherein a box-like card storing portion with the top open is provided for storing collected cards in a stack; the card storing portion has a front portion which configures the front face thereof, a rear portion which configures the rear face thereof, two side portions which configure the left and right side faces thereof, and a plate-like placement board having a placement surface, on which the cards are to be placed; the placement surface is inclined upwardly toward the front side, the rear end of the placement board is connected to the rear portion while the front end of the placement board is separated from the front portion and at least the front portions at both left and right ends of the placement board are separated from the side portions, and the placement board, the front side of which moves in the top-bottom direction, can be elastically deformed.

In the card collection storage of the present invention, the rear end of the placement board of the card storing portion, on which cards are to be placed, is connected to the rear portion of the card storing portion, and the front end of the placement board is separated from the front portion of the card storing portion while at least the front portions at both left and right ends of the placement board are separated from the side portions of the card storing portion, and the placement board, the front side of which moves in the top-bottom direction, can be elastically deformed.

In the present invention, therefore, when the card collection storage in which cards of more than a predetermined number are stacked is pulled from the device frame to the back side, even if the top surface of the card on top of the stack in the card storing portion is in contact with the device frame, the front side of the placement board can be moved downwardly to lower the front end portions of the cards placed on the placement board (i.e., the front end portions of the cards stored in the card storing portion); as a result, the card on top of the stack in the card storing portion can be prevented from being caught by the device frame. Therefore, according to the present invention, although the placement surface on which the cards collected in the card collection storage are placed is inclined upwardly toward the front side, the card collection storage in which the cards of more than a predetermined number are stacked can be extracted to the back.

In the present invention, the front portion, the rear portion, the two side portions and the placement board be formed integrally of resin. With this configuration, the construction of the card collection storage can be simplified, compared to the configuration in which the placement board is formed as a separate member. Consequently, the cost of the card collection storage can be reduced.

In at least an embodiment of the present invention, only the rear end portions at both left and right edges of the place board be connected to the side portions or the entire left and right ends of the placement board are separated from the side portions. With this configuration, the placement board can be elastically deformed to move the front end thereof downwardly even more. Therefore, when the card collection storage in which the cards of more than a predetermined number are stacked is pulled from the device frame to the back side, even if the card on top of the stack in the card storing portion and the device frame are in contact with each other, the top card will not be easily caught by the device frame.

In at least an embodiment of the present invention, an inclined surface inclining downwardly toward the back side be formed on the back surface of the front portion, and at least part of the inclined surface be positioned above the front end of the placement surface. With this configuration, when the placement board is elastically deformed to move the front end thereof downwardly, the front ends of the cards placed on the placement board can be easily lowered. In other words, when the placement board is elastically deformed to move the front end thereof downwardly, the front ends of the cards placed on the placement board will rarely be caught by the back surface of the front portion. Therefore, the front ends of the cards stored in the card storing portion can easily be moved downwardly along with [the downward movement of] the front side of the placement board. Consequently, when the card collection storage in which the cards of more than a predetermined number are stacked is pulled from the device frame to the back side, even if the top card in the stack of cards in the card storing portion and the device frame are in contact with each other, the top card will not easily be caught by the device frame.

In at least an embodiment of the present invention, on the top face of the front portion be formed a front-side protrusion which protrudes upwardly therefrom, and the rear end of the front-side protrusion be positioned behind the rear end of the top face of the front portion. With this configuration, when the card collection storage in which the cards of less than a predetermined number are stacked is abruptly pulled from the back, the front-side protrusion can prevent the cards, which are placed on the top side, from running on the top end face of the front portion. Therefore, even if the card collection storage in which the cards of less than a predetermined number are stacked is abruptly pulled to the back side, a card jam is prevented between the top face of the front portion and the device frame, making it possible to extract the card collection storage to the back side [successfully].

In at least an embodiment of the present invention, on the top face of the rear portion is formed a rear-side protrusion which protrudes upwardly therefrom. With this configuration, the rear-side protrusion prevents the rear ends of the cards stored in the card storing portion from running on the top face of the rear portion. Therefore, a card jam is prevented between the top face of the rear portion and the device frame when the card collection storage in which the cards are stacked is pulled to the back, making it possible for the card collection storage to be pulled to the back side [successfully].

To solve the above problems, at least an embodiment of the present invention provides a card collection storage into which cards collected by a card processing device are taken in diagonally from the upper front and which is inserted to a device frame from the back side of the device frame of the card processing device and mounted to it and which is to be extracted from the back of the device frame; wherein a box-like card storing portion with the open top is provided for storing the collected cards in stack; the card storing portion is constructed with a front portion configuring the front face thereof, a rear portion configuring the rear face thereof, two side portions configuring the left and right side faces thereof, a sheet like placement board having a placement surface on which the cards are placed, and an energizing member for energizing the front end of the placement board upwardly; the placement board is held by the rear portion or the two side portions such that the placement board pivots, having the left-right direction as the axial direction for pivoting, about the rear portion thereof as the center of pivoting; the placement surface is inclined upwardly toward the front side.

In the card collection storage of at least an embodiment of the present invention, the placement board of the card storing portion, on which cards are to be placed, is held by the rear portion or two side portions of the card storing portion such that the placement board can pivot, having the left-right direction as the axial direction for pivoting, about the rear portion of the placement board as the center of pivoting. Also, in at least an embodiment of the present invention, the front side of the placement board is energized by the energizing member upwardly.

Therefore, when the card collection storage in which the cards of more than a predetermined number are stacked is pulled from the device frame to the back side, even if the surface of the card on top of the stack in the card storing portion is in contact with the device frame, the front side of the placement board is moved downwardly to lower the front part of the cards placed on the placement board (i.e., the front part of the cards stored in the card storing portion) downwardly; as a result, the card on top in the stack in the card storing portion is prevented from being caught by the device frame. Therefore, in at least an embodiment of the present invention, although the placement surface on which the cards collected in the card collection storage is inclined upwardly toward the front side, the card collection storage in which the cards of more than a predetermined number are stacked can be pulled from the device frame to the back side [successfully].

The card collection storage of at least an embodiment of the present invention can be applied in a card processing device which is equipped with a device frame, to which the card collection storage is mounted detachably, and a card reader, which is arranged at the diagonally upper front of the card collection storage. In the card processing device, the cards ejected from the card reader are stored in a card storing portion; the device frame has a frame bottom surface which is to be positioned behind the card storing portion and above the card collection storage when the card collection storage is attached to the device frame and which also faces downwardly; when the card collection storage is pulled from the device frame to the back side, if the top surface of the card on top of the stack in the card storing portion is in contact with the frame bottom surface, the placement board is elastically deformed to move the front side of the placement board downwardly. In this card processing device, although the placement surface, on which the cards collected in the card collection storage are placed, is inclined upwardly toward the front side, the card collection storage in which the cards of more than a predetermined number are stacked can be extracted from the device frame to the back side.

Also, the card collection storage of at least an embodiment of the present invention can be used in a card processing device equipped with a device frame, to which the card collection storage is detachably mounted, and a card reader, which is positioned at the diagonally upper front of the card collection storage. In this card processing device, the cards ejected from the card reader are stored in a card storing portion; the device frame has a frame bottom surface which is to be positioned behind the card storing portion and above the card collection storage when the card collection storage is attached to the device frame, and which also faces downwardly; when the card collection storage is pulled from the device frame to the back side, even if the top surface of the card on top of the stack in the card storing portion is in contact with the frame bottom surface, the placement board pivots around the rear end thereof as the center for pivoting to move the front side thereof downwardly. In this card processing device, although the placement surface, on which the cards collected in the card collection storage are placed, is inclined upwardly toward the front side, the card collection storage in which the cards of more than a predetermined number are stacked can be extracted from the device frame to the back side.

As described above, in at least an embodiment of the present invention, although the placement surface on which the cards collected in the card collection storage are placed is made with the upward inclination toward the front side, the card collection storage having the cards of more than a predetermined number stacked therein can be extracted from the device frame to the back side.

BRIEF DESCRIPTION OF THE DRAWING

Embodiments will now be described, by way of example only, with reference to the accompanying drawings which are meant to be exemplary, not limiting, and wherein like elements are numbered alike in several Figures, in which.

DETAILED DESCRIPTION

Figure 1:
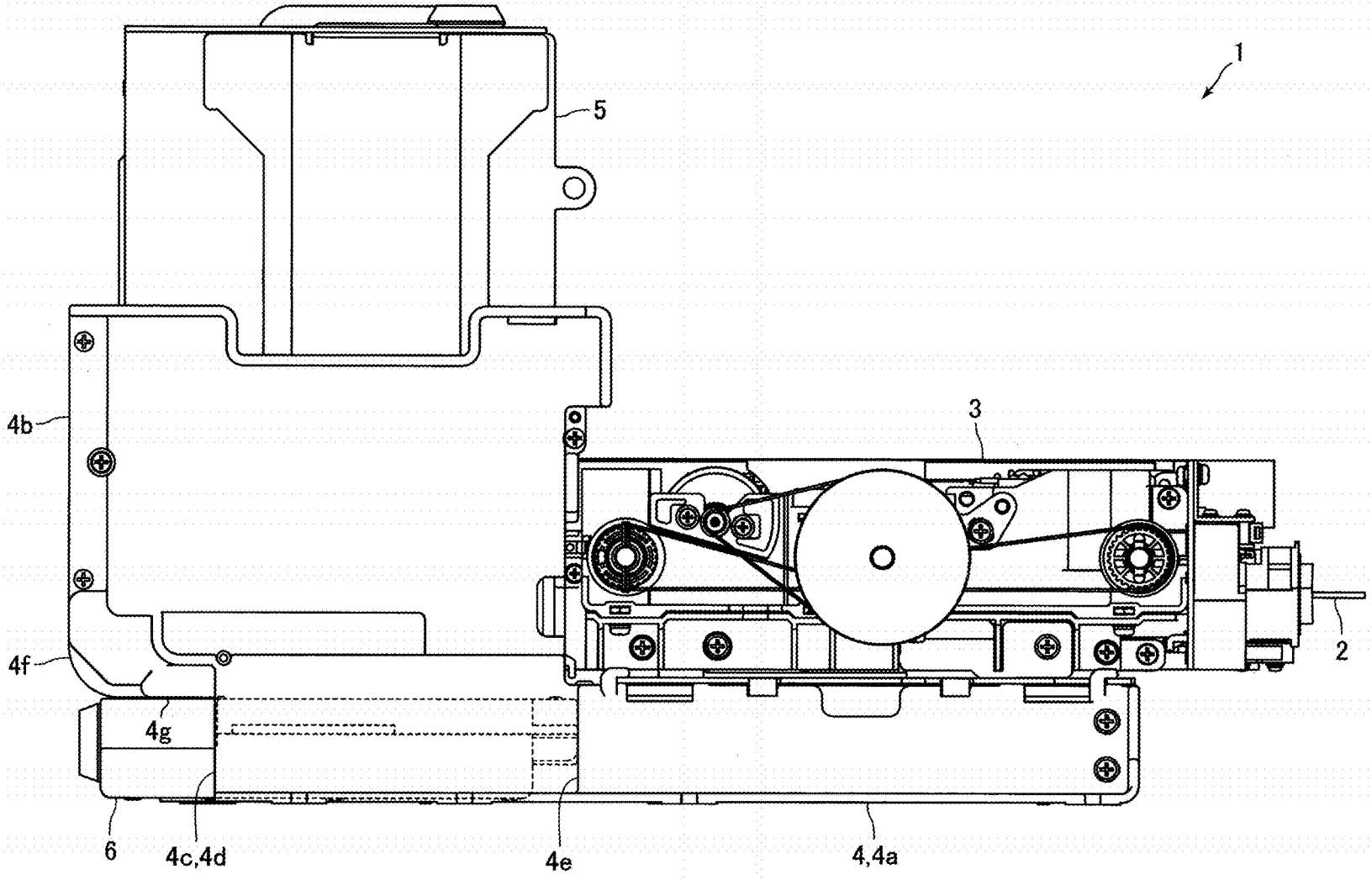
FIG. 1 is a side view of a card processing device of an embodiment of the present invention.

An embodiment of the present invention is described hereinafter, referring to the drawings.

(Configuration of Card Processing Device)

Figure 2A:
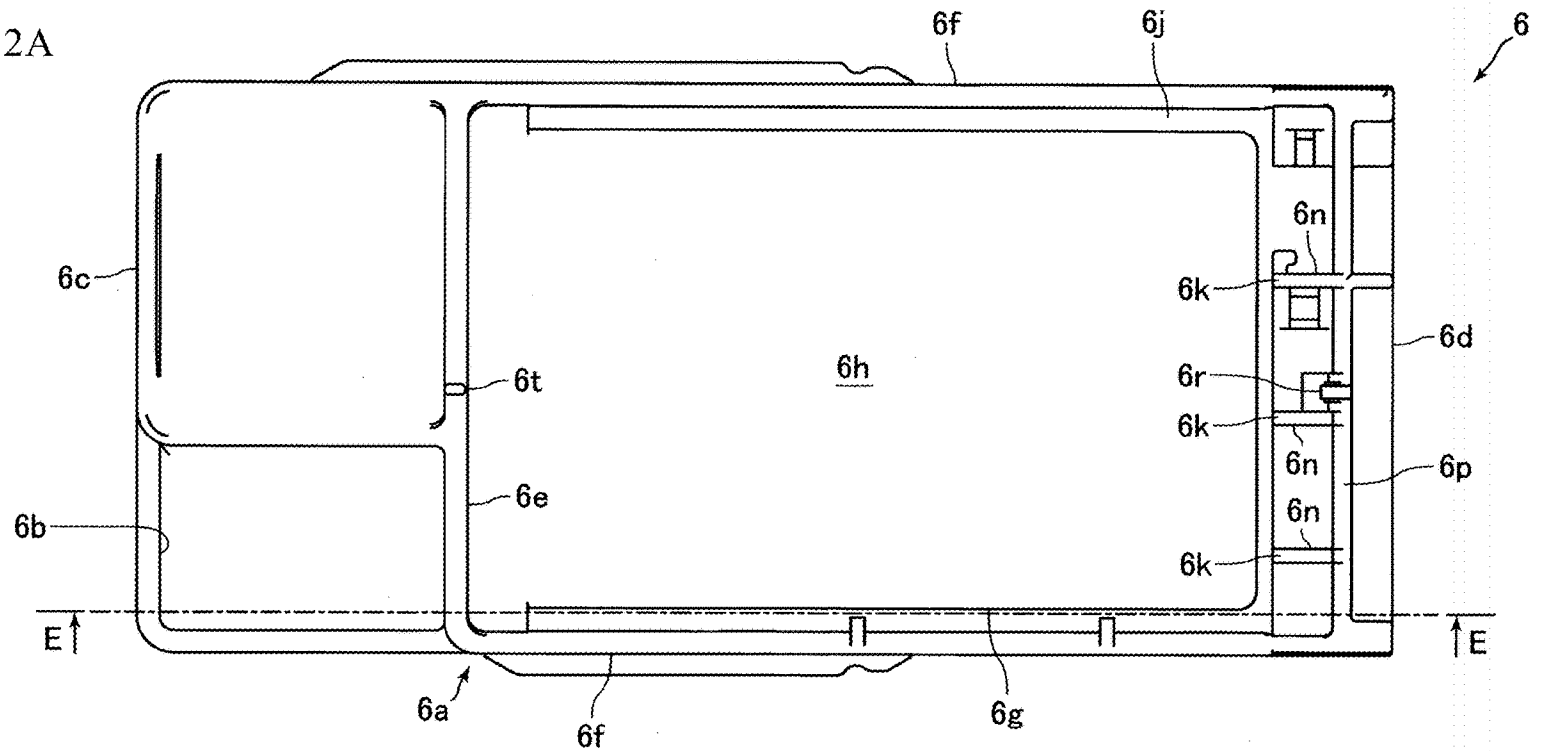
FIG. 2A is a plan view of a card collection storage shown in FIG. 1.
Figure 2B:
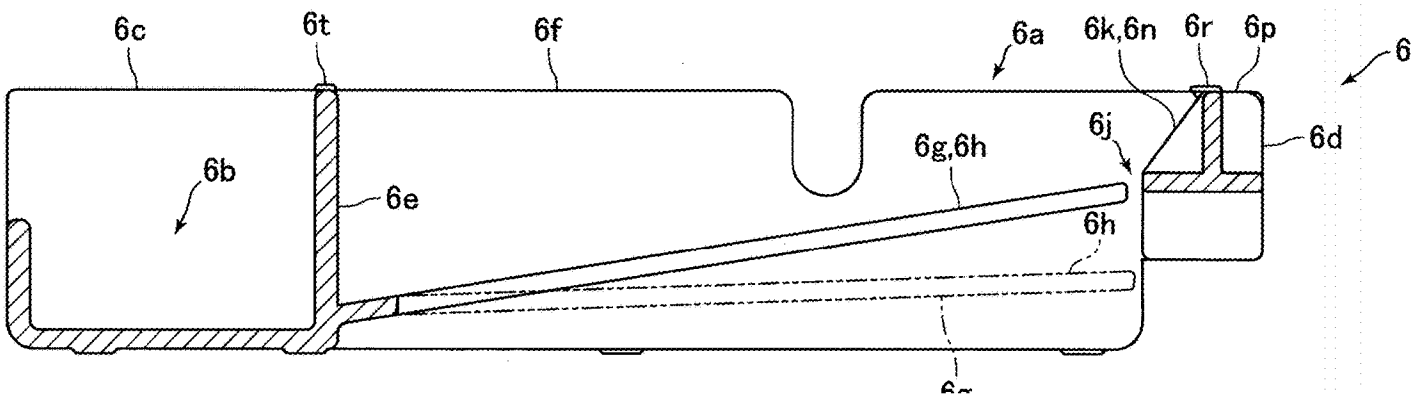
FIG. 2B is a cross-sectional view of an E-E cross section of FIG. 2B.

FIG. 1 is a side view of a card processing device 1 of an embodiment of the present invention. FIG. 2A is a plan view of a card collection storage 6 shown in FIG. 1; FIG. 2B is a cross-sectional view of an E-E cross section of FIG. 2A.

The card processing device 1 implements processing on a card 2. The card processing device 1 of this embodiment is a card issuing device which is equipped with a function to issue cards, which are stored inside, and a function to collect un-needed, expired or error cards 2 (defined as "un-needed cards 2" hereinafter). Therefore, the card processing device 1 of this embodiment is denoted as the "card issuing device 1" hereinafter. The card issuing device 1 is equipped with a card reader 3 which at least reads data recorded on a card 2 or records data on the card 2, and a device frame 4 to which the card reader 3 is mounted.

The card issuing device 1 is also provided with a card supply box 5 in which cards 2 prior to issuing are stored and which is detachably mounted to the device frame 4, and a card collection storage 6 in which the collected cards 2 are stored and which is detachably mounted to the device frame 4. The device frame 4 is formed of resin, for example. The device frame 4 is also configured by a mount portion 4*a* on which the card reader 3 is mounted, a card supply portion 4*b* to which a card supply box 5 is attached, and a card collecting portion 4*c* to which the card collection storage 6 is attached.

The card supply box 5 is arranged above the card collection storage 6. The card reader 3 is arranged on the front side of the card supply box 5 and the card collection storage 6. More specifically described, the card reader 3 is arranged on the front side of the bottom end portion of the card supply box 5. Also, the card reader 3 is arranged at the diagonally upper front of the card collection storage 6. The mount portion 4*a* is connected to the front end of the card collection storage 4*c*. The card supply portion 4*b* is connected to the top end of the card collection portion 4*c*.

The card 2 is a rectangular polyvinyl chloride card having a thickness of 0.7-0.8 mm, for example. On the card 2, a magnetic strip is formed so that magnetic data will be recorded thereon. In the card 2, an IC chip is embedded. Note that the card 2 may be a PET (polyethylene terephthalate) card having a thickness of 0.18-0.36 mm or a paper card having a predetermined thickness.

Inside of the card reader 3, a card transfer pathway is formed so that the card 2 will be transferred therein. The card reader 3 is provided with a card transfer mechanism for transferring the card 2 in the card transfer pathway. Also, the card reader 3 is provided with a magnetic head, an IC contact block, etc. A card supply box 5 is formed in a rectangular parallelepiped shape and the inside thereof is formed as a hollow box to store cards 2. In the card supply box 5, multiple prior-to-issue cards 2 are stacked. The card supply box 5 is inserted into the card supply portion 4*b* of the device frame 4 from the above. The card supply box 5 inserted into the card supply portion 4*b* will be pulled up and removed from the card supply portion 4*b*.

Between the card supply box 5 and the card collection storage 6, a card sending mechanism is arranged to send the card 2 positioned at the bottom of the multiple cards 2 stacked in the card supply box 5 toward the card reader 3. The card sending mechanism is arranged inside of the device frame 4. The card sending mechanism is also provided with a sending claw which engages with the rear end of the card 2 at the bottom in the card supply box 5 and sends the cards 2 one by one from the card supply box 5 and a drive mechanism for driving the sending claw.

The card collection storage 6 is formed in a flat rectangular parallelepiped shape, thin in the top-bottom direction. The card collection storage 6 is also an integrally formed, resin product. The card collection storage 6 is inserted into the card collection portion 4*c* of the device frame 4 from the back side and attached to the card collection portion 4*c*. Also, the card collection storage 6 is to be pulled to the back side of the device frame 4 and removed from the card collection portion 4*c*. In other words, the card collection storage 6 is insertable/removable in a straight line with respect to the card collection portion 4*c*. The card collection storage 6 has a box-like card storing portion 6*a* having an open top, in which the collected cards 2 are stacked. A more concrete configuration of the card storing portion 6*a* is described later.

In the rear end portion of the card collection storage 6 is formed a recess portion 6*b* in which an operator can hook his finger to pull the card collection storage 6. In the rear end portion of the card collection storage 6 is also formed a key storing portion 6*c* for storing a key used to lock the card collection storage 6 to prevent the card collection storage 6 inserted to the card collecting portion 4*c* from being pulled from the card collecting portion 4*c* [accidentally]. The recess portion 6*b* and the key storing portion 6*c* are arranged side by side in the left-right direction. Also, the recess portion 6*b* and the key storing portion 6*c* are positioned behind the card storing portion 6*a*.

The card collecting portion 4*c* has two side portions 4*d* configuring the left and right side faces thereof and a front portion 4*e* configuring the front face thereof. Also, the card collecting portion 4*c* has a top portion 4*f* which is positioned to be above the recess portion 6*b* and the key storing portion 6*c* of the card collection storage 6 when the card collection storage 6 is attached to the card collecting portion 4*c*. The front portion 4*e* is connected to the front ends of the side portions 4*d*. The top portion 4*f* is connected to the top ends of the rear ends of the side portions 4*d*. When the card collection storage 6 is attached to the card collecting portion 4*c*, the front end of the card collection storage 6 is in contact with the front portion 4*e*, and the card storing portion 6*a* is positioned between the two pieces of side portions 2*d*. When the card collection storage 6 is attached to the card collecting portion 4*c*, the rear end of the card storing portion 6*a* and the rear ends of the two pieces of side portions 4*d* coincide with each other in the front-rear direction.

The top surface of the portion of the card collecting portion 4*c*, which is more to the front than the top portion 4*f*, is opened so that the cards ejected from the card reader 3 can [be taken through it] and can be stored in the card storing portion 6*a*. In other words, the portion of the card collecting portion 4*c* [of the device frame] above the card storing portion 6*a* is made open to [take] the cards ejected from the card reader 3 into the card storing portion 6*a* and store them there.

The bottom surface 4*g* of the top portion 4*f* is a flat surface orthogonally intersecting with the top-bottom direction. As described above, the top portion 4*f* is arranged to be above the recess portion 6*b* and the key storing portion 6*c* of the card collection storage 6 when the card collection storage 6 is attached to the card collecting portion 4*c*. In other words, the bottom surface 4*g* is positioned to be behind the card storing portion 6*a* of the card collection storage 6 and to be above the card collection storage 6 when the card collection box is attached to the card collecting portion 4*c*. Under the condition where the card collection storage 6 is inserted to the card storing portion 4*c*, the bottom surface 4*g* of this embodiment is the frame bottom surface which is to be positioned behind the card storing portion 6*a* and above the card collection storage 6 and faces downwardly.

Note that to the card collecting portion 4*c* is mounted a sensor for detecting that the card collection storage 6 is inserted to the card collecting portion 4*c* and another sensor for detecting that a card 2 is taken into the card storing portion 6*a*. These sensors are optical sensors having a light-emitting device and a light-receiving device, for example.

(Configuration of Card Storing Portion)

Figure 3A:
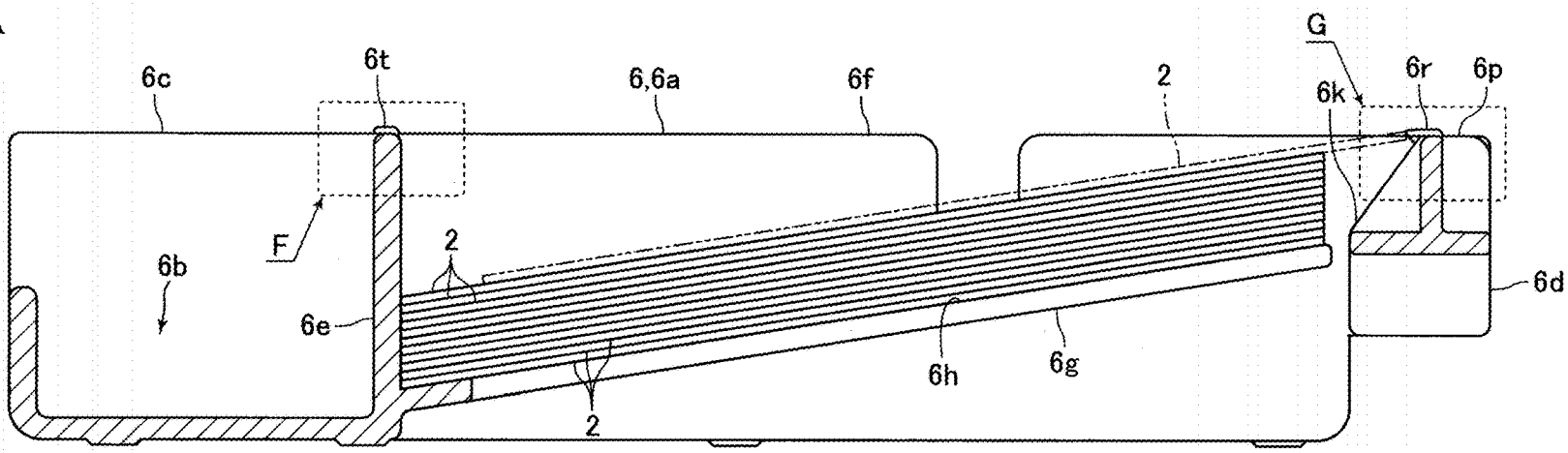
FIG. 3A is a cross-sectional view [of the card collection storage] when cards are stored in a card storing portion shown in FIG. 2B.
Figure 3C:
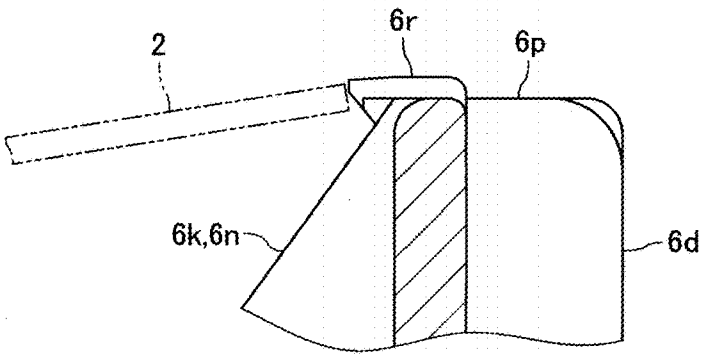
FIG. 3C is a magnified view of the G portion of FIG. 3A.
Figure 3B:
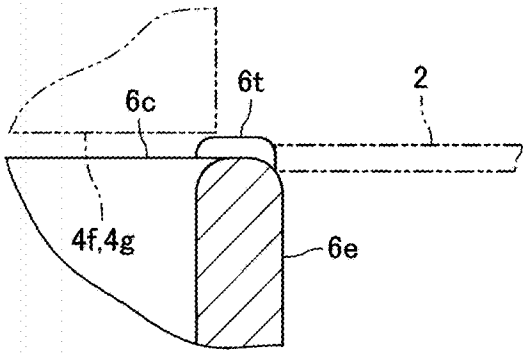
FIG. 3B is a magnified view of the F portion of FIG. 3A.
Figure 4A:
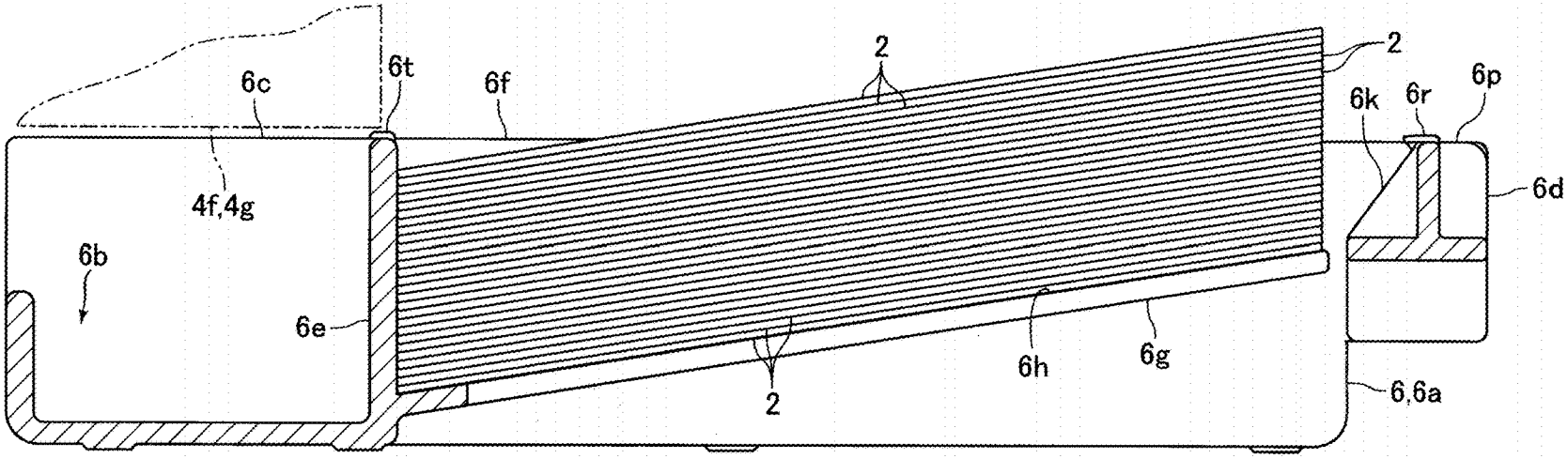
FIG. 4A is a cross-sectional view [of the card collection storage] when cards exceeding a predetermined number are stacked in the card storing portion shown in FIG. 4B.
Figure 4B:
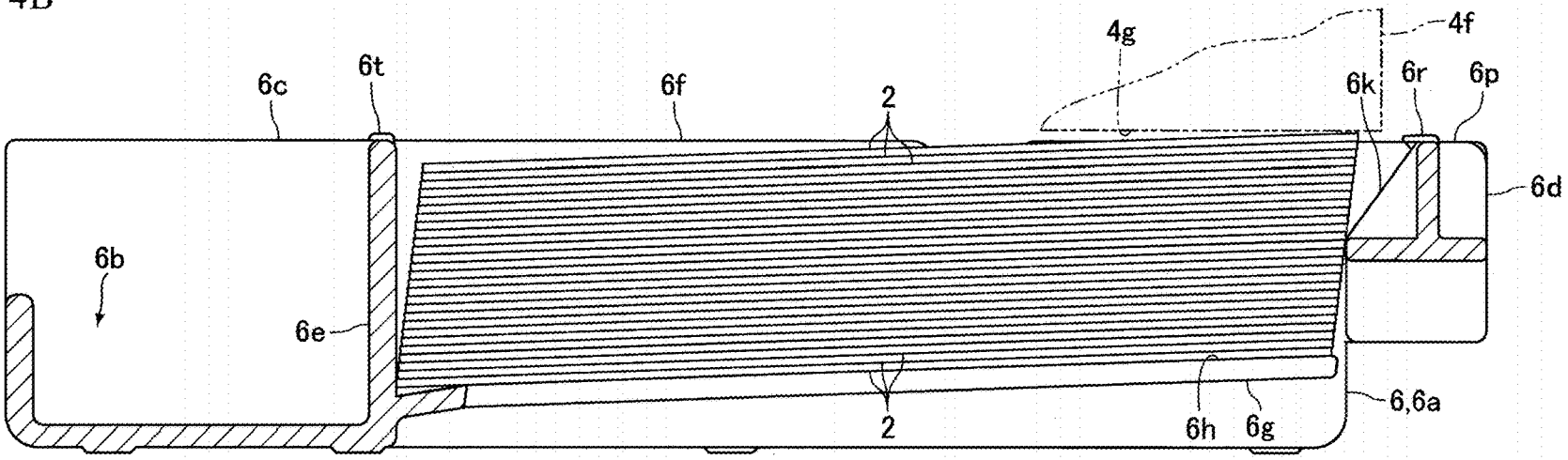
FIG. 4B is a cross-sectional view [of the card collection storage] when the cards are being pulled from a card collecting portion.

FIG. 3A is a cross-sectional view [of the card collection storage 6] in which cards 2 are stored in the card storing portion 6*a* shown in FIG. 2B; FIG. 3B is a magnified view of the F-section in FIG. 3A; FIG. 3C is a magnified view of the G-section in FIG. 3A. FIG. 4A is a cross-sectional view [of the card collection storage 6] in which cards 2 exceeding a predetermined number are stored in the card storing portion 6*a* shown in FIG. 2B; FIG. 4B is a cross-sectional view [of the card collection storage 6] in which the card storing portion 6*a* shown in FIG. 4A is being extracted from the card collecting portion 4*c*.

The card storing portion 6*a* is formed in a flat rectangular parallelepiped shape with the open top. The card storing portion 6*a* is positioned at the diagonally lower back of the card reader 3, and the cards 2 ejected from the card reader 3 are stored therein. In other words, the cards 2 collected in the card issuing device 1 are ejected from the card reader 3 to the back side by the card transfer mechanism of the card reader 3, and the collected cards 2 are taken into the card collection storage 6 from the diagonally upper front.

The card storing portion 6*a* has a front portion 6*d* configuring the front face thereof, a rear portion 6*e* configuring the rear face thereof, two pieces of side portions 6*f* configuring the left and right side faces thereof, and a bottom portion 6*g* configuring the bottom face thereof. The rear portion 6*e* configures the front face of the recess portion 6*b* and the key storing portion 6*c*. The side portions 6*f* configure the most part of the left and right side faces of the card collection storage 6. As described above, the card collection storage 6 is integrally molded resin product; the front portion 6*d*, the rear portion 6*e*, two side portions 6*f* and the bottom portion 6*g* are formed of resin and also integrally molded.

The bottom portion 6*g* is formed in a plate shape. More specifically described, the bottom portion 6*g* is formed in a flat rectangular plate shape. On the top surface of the bottom portion 6*g* is placed the cards 2 which are stored in the card storing portion 6*a*. In other words, the top surface of the bottom portion 6*g* is made as a placement surface 6*h* on which the cards 2 are placed. In this embodiment, the bottom portion 6*g* is a plate-like placement board with a placement surface 6*g*. Therefore, the bottom portion 6*g* is denoted as "the placement board 6*g*." The placement surface 6*h* is inclined upwardly toward the front side. In other words, the placement surface 6*h* is inclined such that the height of the placement surface is gradually increased toward the front side.

The rear end of the placement board 6*g* is connected to the rear portion 6*e*. More specifically described, the entire rear end of the placement board 6*g* is connected to the bottom end of the rear portion 6*e*. The front end of the placement board 6*g* is not connected to the front portion 6*d*. In other words, the entire front end of the placement board 6*g* is separated from the front portion 6*d*. Also, at least the front portions at the left and right side ends of the placement board 6*g* are not connected to the side portions 6*f*. In other words, at least the front portion at the left and right ends of the placement board 6*g* are separated from the side portions 6*f*. In this embodiment, it is only the rear end portions at the left and right side ends of the placement board 6*g* that are connected to the side portions 6*f*, and the rest of the entire left and right side ends of the placement board 6*g* is separated from the side portions 6*f*.

In other words, in the card storing portion 6*a* is formed a notch 6*j* (a U-shaped notch portion 6*j*) which is configured by a slit extending in the left and right direction between the placement board 6*g* and the front portion 6*d* and slits extending in the front-rear direction between the placement board 6*g* and the side portions 6*f*. In this embodiment, therefore, the placement board 6*g*, the front side of which moves in the top-bottom direction, can be elastically deformed, as shown in FIG. 2B. In other words, the placement board 6*g* can be elastically deformed having the rear end portion thereof as a fulcrum point.

On the rear surface of the front portion 6*d* is formed an inclined surface 6*k* which inclines downwardly toward the back side. More specifically described, the front portion 6*d* is formed with multiple triangular flat ribs 6*n* which perpendicularly intersect with the left-right direction and which are arranged at an interval in the left-right direction, and the rear surface of the rib 6*n* is made as the inclined surface 6*k*. The angle of inclination of the inclined surface 6*k* with respect to the front-rear direction is about 45°, for example. The top end of the inclined surface 6*k* is connected to the rear end of the top face 6*p* of the front portion 6*d*. The top face 6*p* is a flat surface perpendicularly intersecting with the top-bottom direction.

The bottom end of the inclined surface 6*k* is positioned higher than the front end of the placement surface 6*h*. In other words, the entire inclined surface 6*k* is positioned higher than the front end of the placement surface 6*h*. In this embodiment, the bottom end of the inclined surface 6*k* is positioned slightly higher than the front end of the placement surface 6*h*. Also, the bottom end of the inclined surface 6*k* is positioned on the front side of the front end of the placement surface 6*h*. Note that the portion of the rear face of the front portion 6*d*, which is positioned higher than the bottom end of the inclined surface 6*k* and is other than the inclined surface 6*k*, is a flat surface perpendicularly intersecting with the front-rear direction; the top end of this flat surface is connected to the rear end of the top face 6*p*.

On the top face 6*p* of the front portion 6*d* is formed a front-side protrusion 6*r* which protrudes upwardly. The front-side protrusion 6*r* is arranged in the center position of the top face 6*p* in the left-right direction. The width of the front-side protrusion 6*r* in the left-right direction is much smaller than the width of the front portion 6*d* in the left-right direction. The rear end of the front-side protrusion 6*r* is positioned more to the back side behind the rear end of the top face 6*p*. In other words, as shown in FIG. 3C, the rear end of the front-side protrusion 6*r* slightly protrudes to the back side from the top end of the front portion 6*d*. The bottom surface of the rear end of the front-side protrusion 6*r* is formed as an inclined surface which inclines upwardly toward the back side. The front-side protrusion 6*r* is provided to prevent the cards 2 stacked on the stop side in the card collection storage 6 from running on the top face 6*p* when the card collection storage 6 is abruptly extracted (referring to FIG. 3C).

On the top end surface of the rear portion 6*e* is formed a rear-side protrusion 6*t* which protrudes upwardly. The rear-side protrusion 6*t* is arranged in the center position in the top end surface of the rear portion 6*e* in the left-right direction. The width of the rear-side protrusion 6*t* in the left-right direction is narrower than the width of the rear portion 6*e* in the left-right direction. The rear-side protrusion 6*t* is provided to prevent the rear end portions of the cards 2 stored in the card storing portion 6*a* from running on the top end surface of the rear portion 6*e*.

In this embodiment, when a predetermined number of cards 2 are stacked in the card collection storage 6, the card collection storage 6 is extracted from the card collecting portion 4*c* [and emptied], and [then] the empty card collection storage 6 is inserted [back] to the card collecting portion 4*c*. When the number of cards 2 stored in the card storing portion 6*a* is less than a predetermined number, the front end of the card 2 on top of the stack of the multiple cards placed on the placement board 6*g* is positioned lower than the top end of the card storing portion 6*a* even if the placement board 6*g* is not elastically deformed, as shown by a solid line in FIG. 3A. Therefore, when the card collection storage 2 having a predetermined number of cards 2 stacked in the card storing portion 6*a* is extracted to the back side, the top surface of the top card 2 in the card storing portion 6*a* does not touch the bottom surface 4*g* of the card collecting portion 4*c*.

On the other hand, when the cards 2 of more than a predetermined number are stored in the card storing portion 6*a*, the cards 2 on the top side in the stack of multiple cards on the placement board 6*g*, which is not elastically deformed, rises higher than the top end of the card storing portion 6*a*, as shown in FIG. 4A. Therefore, when the card collection storage 6 having more than a predetermined number of cards 2 stacked in the card storing portion 6*a* is pulled to the back side, the top surface of the card 2 on top of the stack in the card storing portion 6*a* contacts the bottom surface 4*g* of the card collecting portion 4*c*.

In this embodiment, if the top surface of the card 2 on top of the stack in the card storing portion 6*a* is in contact with the bottom surface 4*g* of the card collecting portion 4*c* when the card collection storage 6 is pulled from the card collecting portion 4*c* to the back side, the placement board 6*g* is elastically deformed to move the front side of the placement board 6*g* downwardly, as shown in FIG. 4B. In other words, if the top surface of the top card 2 in the card storing portion 6*a* is in contact with the bottom surface 4*g* of the card collecting portion 4*c* when the card collecting box 6 is extracted from the card collecting portion 4*c* to the back side, the placement board 6*g* is elastically deformed to lower the front end side of the multiple cards stacked on the placement board 6*g*.

(Major Effects of this Embodiment)

As described above, in this embodiment, the placement board 6*g*, the front side of which moves in the top-bottom direction, can be elastically deformed; if the top surface of the card 2 on top of the stack in the card storing portion 6*a* is in contact with the bottom surface 4*g* of the card collecting portion 4*c* when the card collection storage 6 having the cards 2 of more than a predetermined number stacked in the card storing portion 6*a* thereof is extracted to the back side, the placement board 6*g* is elastically deformed to lower the front end side of the multiple number of cards 2 placed on the placement board 6*g*. In this embodiment, therefore, when the card collection storage 6 having the cards of more than a predetermined number in the card storing portion 6*a* thereof is extracted to the back side, the card 2 on top of the stack of the cards in the card storing portion 6*a* can be prevented from getting caught by the device frame 4.

Particularly in this embodiment, since only the rear end portions at both left and right ends of the placement board 6*a* are connected to the side portions 6*f* and the rest of the left and right ends of the placement board 6*g* are separated from the side portions 6*f*, the placement board 6*g* can be elastically deformed to move the front side of the placement board 6*g* significantly downwardly. In this embodiment, therefore, even if the card 2 on top of the stack of the cards in the card storing portion 6*a* is in contact with the device frame 4 when the card collection storage 6 having the cards 2 of more than a predetermined number stored therein is extracted to the back side, the top card 2 rarely gets caught by the device frame 4. Consequently, in this embodiment, although the placement surface 6*h* is inclined upwardly toward the front side, the card collection storage 6 having the cards 2 of more than a predetermined number stacked therein can be [smoothly] extracted to the back side.

In this embodiment, also, the inclined surface 6*k* which inclines downwardly toward the back side is formed on the rear surface of the front portion 6*d*, and the entire inclined surface 6*k* is positioned higher than the front end of the placement surface 6*h*. Therefore, in this embodiment, when the placement board 6*g* is elastically deformed for the front side of the placement board 6*g* to move downwardly, the front ends of the cards 2 placed on the placement board 6*g* easily move along the inclined surface 6*k*. In other words, when the placement board 6*g* is elastically deformed to have the front side of the placement board 6*g* to move downwardly, the front ends of the cards 2 placed on the placement board 6*g* rarely get caught on the rear surface of the front portion 6*d*. Therefore, in this embodiment, the front end portion of the cards 2 stored in the card storing portion 6*g* can be easily lowered following [the downward movement of] the front side of the placement board 6*g*; as a result, even if the cards 2 of more than a predetermined number are stacked cards in the card storing portion 6*a* and the card 2 on top of the stack the is in contact with the device frame 4, the card 2 on top of the stack will not easily caught by the device frame 4 when he card collection storage 6 is extracted to the back side.

In this embodiment, the front portion 6*d*, the rear portion 6*e*, two side portions 6*f* and the placement board 6*g* are integrally formed of resin. Therefore, in this embodiment, the configuration of the card collection storage 6 can be simplified, compared to the case in which the placement board 6*g* is formed as a separate member; as a result, the cost of the card collection storage 6 can be reduced.

In this embodiment, the front-side protrusion 6*r* formed on the top face 6*p* of the front portion 6*d* is provided to prevent the cards 2 stacked on the top side from running on the top face 6*p* when the card collection storage 6, in which the cards 2 are stacked, is abruptly extracted. Therefore, in this embodiment, even when the card collection storage 6 in which the cards 2 of less than a predetermined number are stacked is extracted to the back side abruptly, a jam that may occur between the cards 2 between the top face 6*p* and the bottom surface 4*g* of the device frame 4 can be prevented so that the extraction of the card collection storage 6 to the back side is made possible.

Note that, in this embodiment, since the inclined surface 6*k* is formed on the back surface of the front portion 6*d*, the front ends of the cards 2 stacked on the top side may easily moves along the inclined surface 6*k* and run on the top face 6*p* of the front portion 6*d* when the card collection storage 6 is pulled abruptly even if the cards stored therein is less than a predetermined number. However, in this embodiment, because of the front-side protrusion 6*r*, the cards 2 stacked on the top side are prevented from running on the top end surface 6*p*.

In this embodiment, the rear-side protrusion 6*t* formed on the top surface of the rear portion 6*e* is provided to prevent the rear ends of the cards 2 stored in the card storing portion 6*a* from running on the top surface of the rear portion 6*e*. Therefore, in this embodiment, the jam of the cards 2 that may occur between the top surface of the rear portion 6*e* and the bottom surface 4*g* of the device frame 4 is prevented when the card collection storage 6 having the cards 2 stacked therein is pulled to the back side so that the extraction of the card collection storage 6 to the back side is made possible.

Other Embodiments

The above-described embodiment is one of the preferred examples of the present invention; however, it is not limited to this, and can be variously modified.

In the above-described embodiment, only the rear end portions at both left and right edges of the placement board 6*g* are connected to the side portions 6*f* and the rest of the left and right ends of the placement board 6*g* is separated from the side portions 6*f*; however, only the front end portions at the left and right edges of the placement board 6*g* may be separated from the side portions 6*f* Also, the entire left and right edges of the placement board 6*g* may be separated from the side portions 6*f*. In the above-described embodiment, the entire rear end of the placement board 6*g* is connected to the rear portion 6*e*; however, part of the rear end of the placement board 6*g* may not be connected to the rear portion 6*e*.

The placement board 6*g* may be formed as a separate member from the front portion 6*d*, the rear portion 6*e* and two side portions 6*f*. In this case, the placement board 6*g* may be a metallic sheet spring formed of a stainless sheet, for example. Also, in this case, the rear end of the placement board 6*g* is secured and connected to the rear portion 6*e* by a screw, etc.

When the placement board 6*g* is formed as a separate member from the front portion 6*d*, the rear portion 6*e* and two side portions 6*f*, the placement board 6*g* may be held by two side portions 6*f* such that the rotation of the placement board 6*g* having the left-right direction as the axial direction of rotation and the rear end thereof as the center of rotation. In this case, the card storing portion 6*a* is provided with a fixed shaft 11, one end of which is fixed to one of the two side portions 6*f* and the other end of which is fixed to the other of the two side portions 6*f*; in the rear end portion of the placement board 6*g*, a through hole is formed for the fixed shaft 11 to be inserted through. In this case, also, the card storing portion 6*a* is provided with a compression coil spring 12 as an energizing member to energize the front side of the placement board 6*g* upwardly; the placement surface 6*h* is inclined upward toward the front side.

In this case, when the card collection storage 6 having the cards 2 of more than a predetermined number is pulled to the back side while the top surface of the card 2 on top of the stack in the card storing portion 6*a* is in contact with the bottom surface 4*g* of the card collecting portion 4*c*, the placement board 6*g* pivots around the rear end thereof as the center (more specifically, pivots on the fixed shaft 11 as the center) to move the front end of the place board 6*g* downwardly. In other words, the front ends of the multiple cards 2 placed on the placement board 6*g* are lowered.

Figure 5:
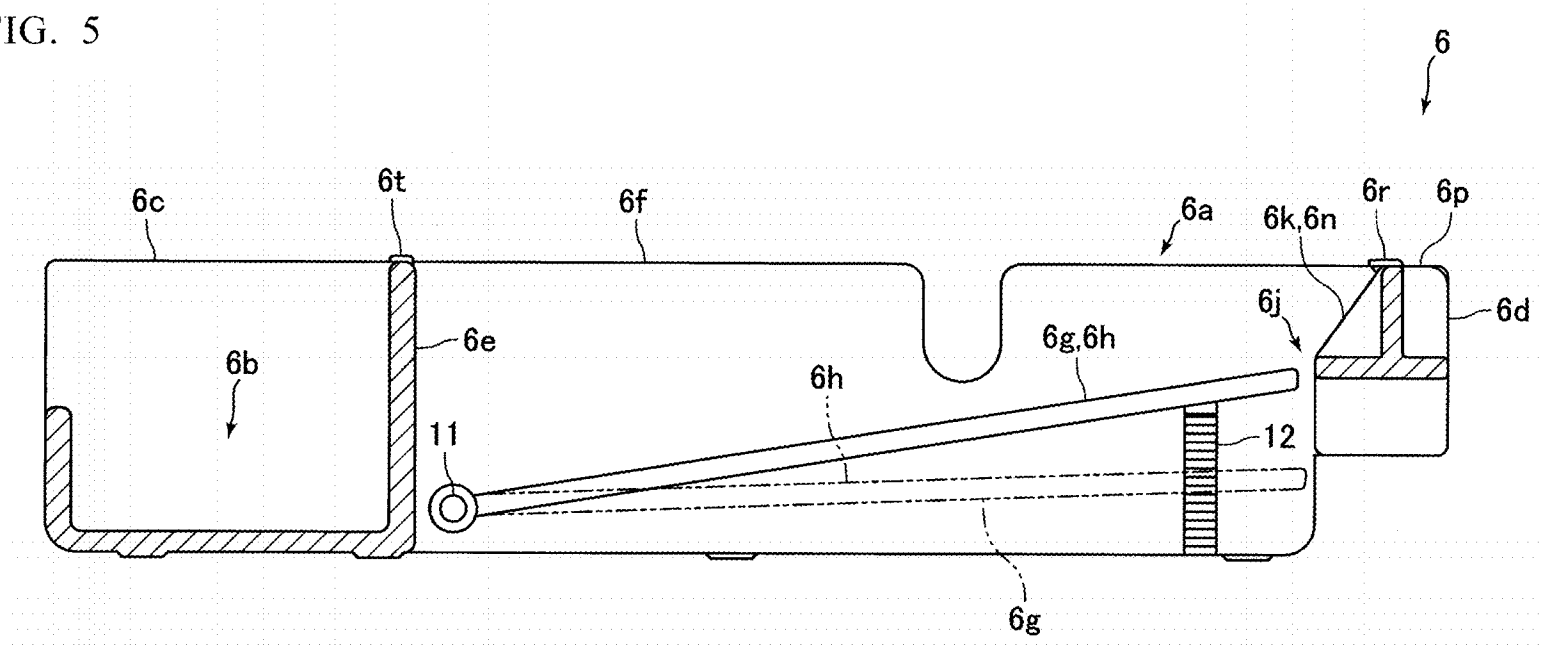
FIG. 5 is a cross-sectional view [of a card collection storage] of another embodiment of the present invention to explain the configuration thereof.

Therefore, even in this case, when the card collection storage 6, in which the cards 2 of more than a predetermined number are stacked in the card storing portion 6*a* thereof, is pulled to the back side, the card 2 on top of the stack in the card storing portion 6*a* can be prevented from being caught by the device frame 4. Therefore, even in this case, the card collection storage 6 having the cards 2 of more than a predetermined number stacked therein can be extracted to the back side. In other words, the placement board 6*g* may be held by the rear portion 6*e* such that the placement board 6*g* can pivot having the left-right direction as the axial direction and about the rear end thereof as the center. Note that in FIG. 5, the same codes are given to the same configuration as in the above-described embodiment.

The bottom end of the inclined surface 6*k* may be positioned lower than the front end of the placement surface 6*h*. In other words, part of the top end of the inclined surface 6*k* may be positioned higher than the front end of the placement surface 6*h*. Also, the recess portion 6*b* and the key storing portion 6*c* in the above-described embodiment may not be formed. In other words, the card storing portion 6*g* itself may be the card collection storage 6. Further, the placement board 6*g* may not configure the bottom surface of the card storing portion 6*a*. In other words, the card storing portion 6*a* may be provided with a bottom portion, which configures the bottom surface of the card storing portion 6*a*, under the placement board 6*g*.

The card collection storage 6 is used in the card issuing device 1 in the above-described embodiment; however, the card collection storage 6 may be used in a card processing device other than the card issuing device 1. For example, if the card collection storage 6 is not provided with a function to issue a card 2, it may be used in a card processing device equipped with a function to issue a card 2.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A card collection storage which is inserted into a device frame from a back side of said device frame of a card processing device and attached to said device frame and is to be pulled from said device frame to the back side of said device frame and removed from said device frame, wherein cards collected by the card processing device, which performs processes on the cards, are taken into the card collection storage in diagonally from an upper front of the card collection storage, the card collection storage comprising:

a box-shaped card storing portion comprising an open top, in which said collected cards are stacked;

wherein said card storing portion comprises a front portion configuring a front face of said card storing portion, a rear portion configuring a rear face of said card storing portion, two side portions configuring left and right side faces of said card storing portion, and a plate-shaped placement board having a placement surface on which said cards are to be placed, said placement surface is inclined upward toward a front side of said placement surface, a rear end of said placement board is connected to said rear portion, a front end of said placement board is separated from said front portion and at least front portions at left and right ends of said placement board are separated from said side portions, and said placement board, a front side of which moves in a top-bottom direction, can be elastically deformed.

2. The card collection storage set forth in claim 1, wherein said front portion, said rear portion, said two side portions and said placement board are integrally formed of resin.

3. The card collection storage as set forth in claim 2, wherein only rear end portions at the left and right ends of said placement board are connected to said side portions, or the entire left and right ends of said placement board are separated from said side portions.

4. The card collection storage as set forth in claim 3, wherein on a back surface of said front portion is formed an inclined surface which inclines downwardly toward a back side of the back surface, and at least part of said inclined surface is positioned higher than the front side of said placement surface.

5. The card collection storage as set forth in claim 3, wherein on a top face of said front portion is formed a front-side protrusion which protrudes upwardly therefrom, and a rear end of said front-side protrusion is positioned more to a back side behind a rear end of said top face of said front portion.

6. The card collection storage as set forth in claim 5, wherein on a top face of said rear portion is formed a rear-side protrusion which protrudes upwardly therefrom.

7. The card collection storage as set forth in claim 3, wherein on a top face of said rear portion is formed a rear-side protrusion which protrudes upwardly therefrom.

8. The card collection storage as set forth in claim 2, wherein on a back surface of said front portion is formed an inclined surface which inclines downwardly toward a back side of the back surface, and at least part of said inclined surface is positioned higher than the front side of said placement surface.

9. The card collection storage as set forth in claim 2, wherein on a top face of said front portion is formed a front-side protrusion which protrudes upwardly therefrom, and a rear end of said front-side protrusion is positioned more to a back side behind a rear end of said top face of said front portion.

10. The card collection storage as set forth in claim 9, wherein on a top face of said rear portion is formed a rear-side protrusion which protrudes upwardly therefrom.

11. The card collection storage as set forth in claim 2, wherein on a top face of said rear portion is formed a rear-side protrusion which protrudes upwardly therefrom.

12. The card collection storage as set forth in claim 1, wherein only rear end portions at the left and right ends of said placement board are connected to said side portions, or entire left and right ends of said placement board are separated from said side portion.

13. The card collection storage as set forth in claim 12, wherein on a back surface of said front portion is formed an inclined surface which inclines downwardly toward a back side of the back surface.

14. The card collection storage as set forth in claim 12, wherein on a top face of said front portion is formed a front-side protrusion which protrudes upwardly therefrom.

15. The card collection storage as set forth in claim 14, wherein on a top face of said rear portion is formed a rear-side protrusion which protrudes upwardly.

16. The card collection storage as set forth in claim 12, wherein on a top face of said rear portion is formed a rear-side protrusion which protrudes upwardly therefrom.

17. The card collection storage as set forth in claim 1, wherein on a back surface of said front portion is formed an inclined surface which inclines downwardly toward a back side of the back surface; and at least part of said inclined surface is positioned higher than the front side of said placement surface.

18. The card collection storage as set forth in claim 1, wherein on a top face of said front portion is formed a front-side protrusion which protrudes upwardly therefrom;

a rear end of said front-side protrusion is positioned more to a back side behind the rear end of said top face of said front portion.

19. The card collection storage as set forth in claim 18, wherein on a top face of said rear portion is formed a rear-side protrusion which protrudes upwardly therefrom.

20. The card collection storage as set forth in claim 1, wherein on a top face of said rear portion is formed a rear-side protrusion which protrudes upwardly therefrom.

21. A card collection storage which is inserted into a device frame from a back side of said device frame of a card processing device and attached to said device frame and is to be pulled from said device frame to the back side of said device frame and removed from said device frame, wherein cards collected by the card processing device, which performs processes on the cards, are taken into the card collection storage in diagonally from an upper front of the card collection storage, comprising:

a box-shaped card storing portion having an open top, in which said collected cards are stacked;

wherein said card storing portion comprises a front portion configuring a front face thereof, a rear portion configuring a rear face thereof, two side portions configuring left and right side faces thereof, a plate-like placement board having a placement surface on which said cards are to be placed, and an energizing member for energizing a front end of said placement board upwardly, said placement board is held by said rear portion or said two side portions such that said placement board can pivot, having a left-right direction as an axial direction, about a rear end portion thereof as a center of the pivot, and said placement board is inclined upwardly toward a front side of said placement surface.

22. A card processing device comprising:

a card collection storage;

a device frame to which said card collection storage is mounted detachably; and a card reader which is arranged in a diagonally upper front of said card collection storage;

wherein said card collection storage comprises a box-shaped card storing portion which is to be inserted and attached to said device frame from a back side of said device frame and is to be pulled from the back side of said device frame and removed from said device frame, and has an open top in which cards are stacked;

said cards collected by a card processing device, which performs processes on the cards, are taken into the card collection storage in diagonally from an upper front of the card collection storage;

said card storing portion comprises a front portion configuring a front face thereof, a rear portion configuring a rear face thereof, two side portions configuring left and right side faces thereof and a plate-like placement board having a placement surface on which said cards are to be placed;

said placement surface is inclined upwardly toward a front side of said placement surface;

a rear end of said placement board is connected to said rear portion, a front end of said placement board is separated from said front portion while at least front portions at left and right ends of said placement board are separated from said side portions, and said placement board, a front side of which moves in a top-bottom direction, can be elastically deformed;

in said card storing portion are stored said cards ejected from said card reader;

on said device frame is formed a frame bottom surface which is to be positioned behind said card storing portion and above said card collection storage when said card collection storage is attached to said device frame, and the frame bottom surface faces downwardly; and when said card collection storage is pulled from said device frame to the back side, a top surface of a top card of the stacked cards in said card storing portion contacts said frame bottom surface, and said placement board is elastically deformed so that the front end of said placement board moves downwardly.

23. A card processing device comprising:

a card collection storage including a box-shaped card storing portion having an open top and a plate-like placement board having a placement surface on which cards are to be placed;

a device frame to which said card collection storage is detachably mounted; and a card reader;

wherein in said card storing portion are stored said cards which are ejected from said card reader;

on said device frame is formed a frame bottom surface which is to be positioned behind said card storing portion and above said card collection storage when said card collection storage is attached to said device frame, and the frame bottom surface faces downwardly; and when said card collection storage is pulled from said device frame to a back side of said device frame, a top surface of a top card in a stack of said cards in said card storing portion is in contact with said frame bottom surface, and said placement board pivots about a rear end portion of said placement board as a center to move a front end of said placement board downwardly.

* * * * *